US008117980B1

(12) United States Patent
Cichoski

(10) Patent No.: US 8,117,980 B1
(45) Date of Patent: Feb. 21, 2012

(54) RIGID QUICK CONNECT MOORING DEVICE

(76) Inventor: Jeffrey Jerome Cichoski, Saint Louis Park, MN (US)

( * ) Notice: Subject to any disclaimer, the term of this patent is extended or adjusted under 35 U.S.C. 154(b) by 41 days.

(21) Appl. No.: 12/660,541

(22) Filed: Mar. 1, 2010

(51) Int. Cl.
*B63B 21/00* (2006.01)

(52) U.S. Cl. ..... 114/230.15

(58) Field of Classification Search ..... 114/230.1, 114/231, 230.15–230.19
See application file for complete search history.

(56) References Cited

U.S. PATENT DOCUMENTS 1,094,610 A * 4/1914 Steinhauer ..... 114/230.18
2,526,162 A * 10/1950 Schuelke ..... 114/230.15
4,708,083 A 11/1987 Billings
4,977,846 A 12/1990 Landa et al.
5,408,946 A * 4/1995 Jones et al. ..... 114/230.1
6,561,113 B2 5/2003 Leise
6,910,435 B2 6/2005 Hadcroft et al.
6,962,122 B1 11/2005 Bouldin, Jr.
6,994,047 B1 2/2006 Pent, III
7,089,877 B1 8/2006 Hay
7,100,527 B2 9/2006 Munro

* cited by examiner

*Primary Examiner* — Edwin Swinehart

(57) ABSTRACT

A rigid mooring system that instantly secures pontoons, float planes, boats, and other forms of craft to a variety of dockage types and consists of two identical, yet separately positioned devices which together moor a craft safely away from the dockage. Barrel plate hinges permanently secure the two devices to the dockage allowing both the devices and the attached craft vertical motion but prohibit parallel or lateral movement. Each device has two reinforced arms coming together to form a right triangle shaped rigid body with one arm projecting further, bending into a curved attaching end. This attaching end is integrated with a self closing latch. The latch opens when pressed against the craft's mooring fixture then automatically snaps back into place capturing the craft. Pressing the release button opens the latch, freeing the craft. Each device also provides a place for a separate lock to be installed preventing theft or unauthorized use of the craft.

19 Claims, 3 Drawing Sheets

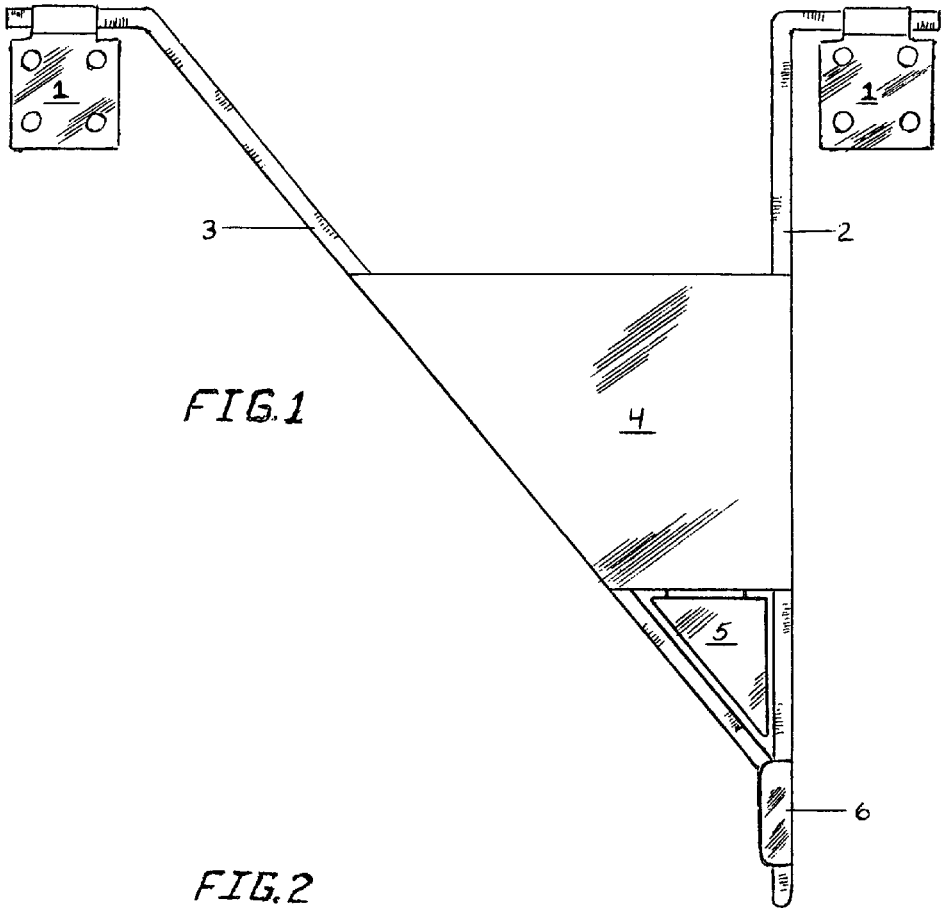
FIG. 1
FIG. 2
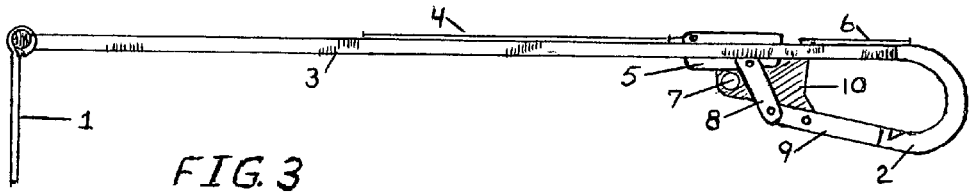
FIG. 3
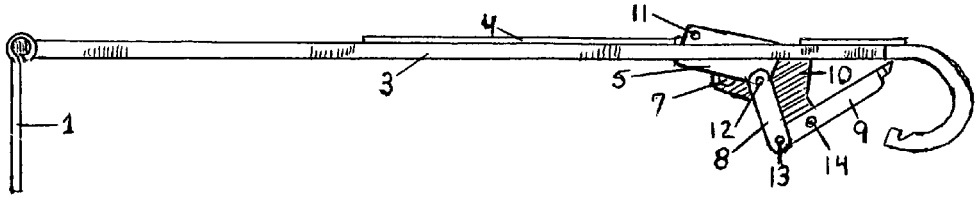

RIGID QUICK CONNECT MOORING DEVICE

BACKGROUND

This invention is intended for, but not limited to the watercraft, pontoon, and amphibious aircraft fields. This invention addresses and solves mooring failures and faults including: rope, lashing, and tether failure, ineffective tie down knots, bumper, fender, or pad protection failure, craft damage or loss due to inexperienced mooring knowledge and application, craft damage due to battering against the dockage, loss of craft due to theft, and mooring difficulty caused by wind, rolling water, and other natural conditions. Previous designs such as Hay (U.S. Pat. No. 7,089,877), Billings (U.S. Pat. No. 4,708,083), and Landa et al. (U.S. Pat. No. 4,977,846) require a combination of hard and soft components. Soft components include components that may rot, break, be cut or be displaced. The hard components of previous designs while adequate for lateral restraint may not offer sufficient strength in adverse conditions to hold the forward and backward movement of a craft. Failure in any of these areas may result in extensive damage to the craft and or the dockage. Designs such as Pent, III (U.S. Pat. No. 6,994,047) and Hadcroft et al. (U.S. Pat. No. 6,910,435) when installed create a tripping hazard and or obstruction to pedestrian traffic on the dock. Current designs also fail to address the challenge of speed and ease of use in all types of conditions by novice operators. Other prior art U.S. patents include U.S. Pat. No. 6,561,113 to Leise and U.S. Pat. No. 7,100,527 to Munro.

SUMMARY

This invention was born out of a need to safely moor a craft with ease quickly and securely by persons of any experience level. Comprised of two identical triangular shaped devices manufactured of steel this system forms a solid connection between the dockage and the craft. Unlike previous designs, each device has two permanent hinged connection points at the dockage and a solid steel connection at the craft forming a reinforced triangle which pivots vertically while holding the craft in place laterally, prohibiting forward or backward movement as well. The barrel plate hinges of this invention are mounted to the side of the dockage keeping the walkway clear, unlike previous systems which pose a tripping threat. This system allows the devices to pivot vertically and rest against the dockage when unused leaving the mooring area and dockage clear, unlike some previous systems which create an impediment for approaching craft and other assorted activities.

The steel connecting points of this system are immune from abrasion wear, rotting, cutting, breaking and bending problems to which other designs using pliable or organic materials are subject. Providing a fixed space between the craft and dock prevents contact damage which eliminates the need for ropes, whips, bumpers, fenders, pads, buoys and other devices which may fail due to loss, inaccurate placement, or unforeseen displacement.

The self closing spring loaded latch instantly opens upon contact grasping the u-bolt, cleat, bow eye or other tie down device on the watercraft. With a push of the release button the craft is freed. After release gravity pivots the devices down to a vertical position against the dock where they remain hanging until needed. These actions are accomplished instantly with minimal effort or experience unlike current systems requiring tying and untying knots, looping ropes, lashings, tethers, insertion and removal of pins and clips, manual clasps and clamps, chaining, etc.

Unlike previous systems these devices also offer the option of being locked with a separate padlock thus preventing theft or unauthorized release of the craft.

DESCRIPTION OF THE VIEWS

FIG. 1 illustrates the top view of the invention.

FIG. 2 illustrates the invention in a side view, horizontal position, with the release assembly components in a normal closed position.

FIG. 3 illustrates the invention in a side view, horizontal position, with the release assembly components in the open position.

LEGEND OF COMPONENTS

Figure 4:
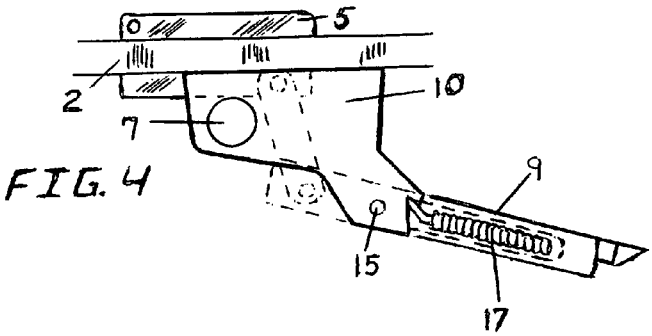
FIG. 4 illustrates a side view of the main tang and it's relationship with the release assembly components.
Figure 5:
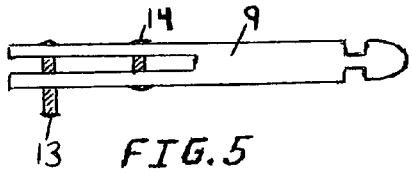
FIG. 5 illustrates a top view of the latch arm and connecting pins.

1. Barrel plate hinges
2. Primary arm
3. Brace arm
4. Main brace plate
5. Release button
6. Small brace plate
7. Lock access opening
8. Push arm
9. Latch
10. Main tang
11. Release button hinge pin
12. Push arm pin
13. Latch pin
14. Main tang pivot pin
15. Pivot pin access hole
16. Hinge pin plate
17. Latch spring

DETAILED DESCRIPTION OF THE INVENTION

This invention preferably is to be manufactured entirely of stainless steel for strength and impunity to corrosion. Two of these devices are needed to secure a watercraft as seen in FIG. 9.

Figure 7:
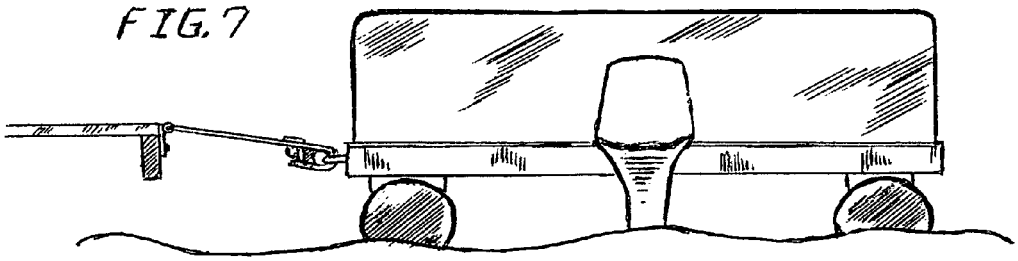
FIG. 7 illustrates this device holding a craft by the craft's u-bolt.
Figure 8:
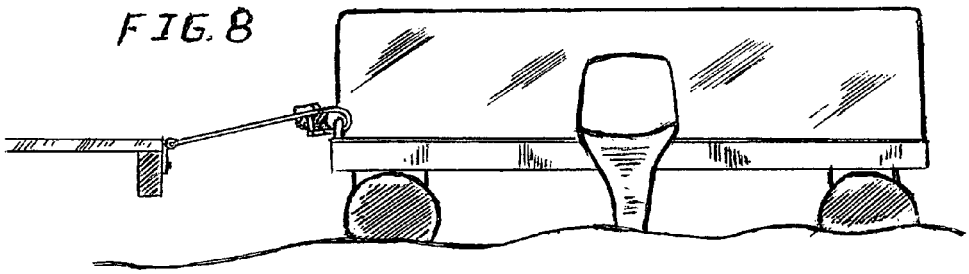
FIG. 8 illustrates this device holding a craft by the craft's bow eye.

The primary arm 2 and brace arm 3 as seen in FIG. 1 and the latch arm 9 in FIG. 2 are round stock. The pins 11, 12, 13, and 14 in FIG. 3 are also round stock. The remaining parts are formed of various thicknesses of flat stock. The preferred connection of non moving parts will be, but not limited to, welding. This invention must be attached to the dock or mooring structure by bolting, screwing, or welding the two pre drilled barrel plate hinges 1 of FIG. 1 to the side of the dock with the hinge barrels positioned horizontally. Mounted in this fashion the barrel hinge plate should be no higher than the dock surface as seen in FIG. 7 so as not to interfere with a smooth dock surface. While the system is in use the barrel plate hinges 1 allow the primary arm 2, and brace arm 3, of FIG. 1, to rotate up and down with the wave action or water level variation. The invention can swing down flat against the dockage when not in use, out of site and out of the way.

Figure 9:
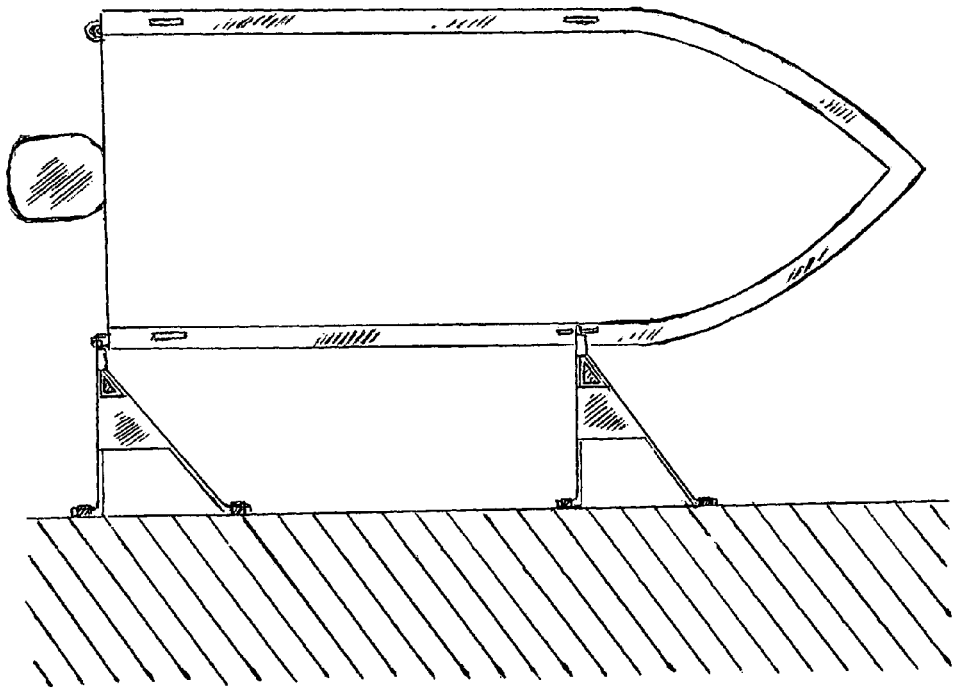
FIG. 9 is an overhead view of the invention holding a craft in place and shows the aft device connecting to a rear u-bolt on the craft, with the forward device connected to a cleat on the craft.

When the craft to be moored draws within arms reach of the dock the invention is swung upwards with one hand, by a person dockside or aboard the craft, then pressed down against the craft's mooring bolt or tie down device instantly securing the craft as seen in FIG. 9.

To make this function happen, the latch 9 of FIG. 3 opens when pressed onto the craft's mooring bolt or tie down device. Constant pressure from the latch spring 17, of FIG. 4, returns the latch 9 to the closed position as shown in FIG. 2 thus securing the craft. Once attached to the craft the primary arm 2, and angled brace arm 3, of FIG. 1, together forming the framework of the device will not let the craft move forward, back, outward or inward. The primary arm 2, and brace arm 3, are reinforced by the main brace plate 4 and the small brace plate 6 which are welded into position as shown in FIG. 1. A lock can be put on the invention thru the lock access opening 7 in the main brace tang 10 shown in FIG. 4. This prevents the release button 5 of FIG. 2 from being depressed making it impossible to open the latch and free the craft.

Figure 6:
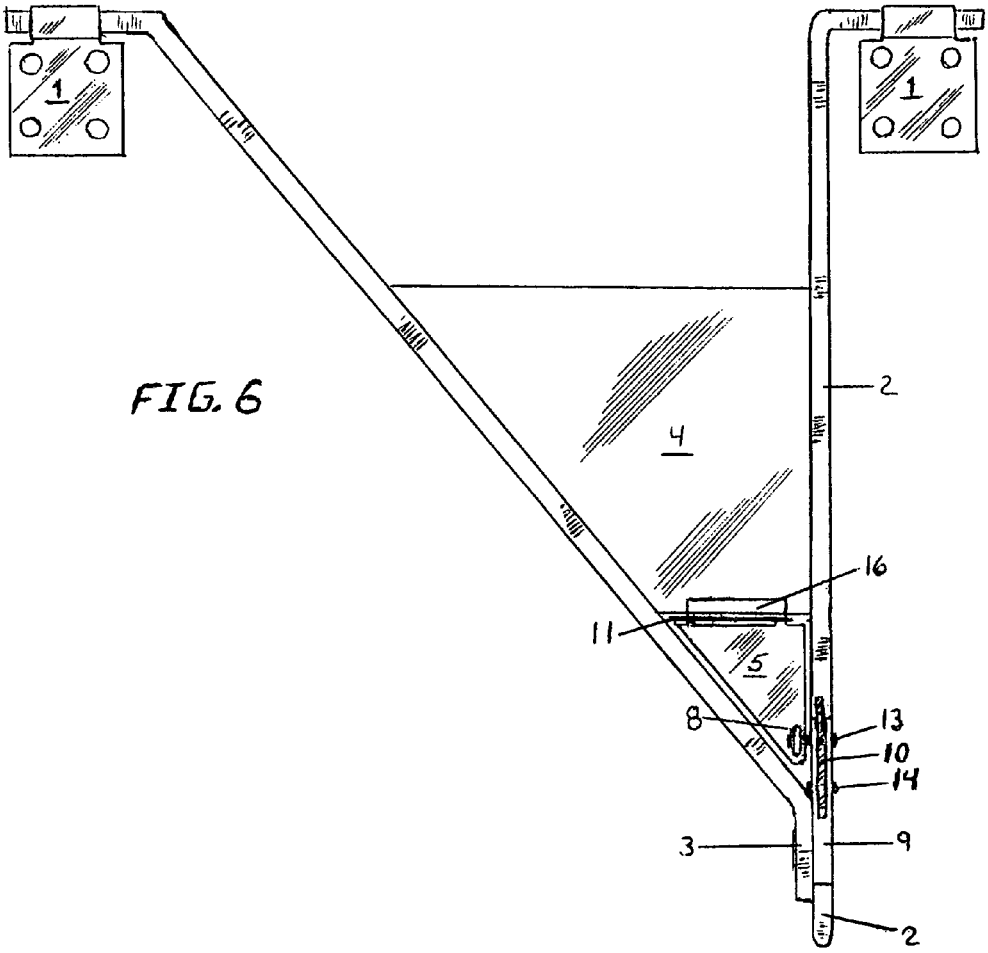
FIG. 6 illustrates the underside view of the device.

To release the invention from the moored craft the separate lock, if one has been applied, must first be removed from the lock access 7, shown in FIG. 4. A person on the dockage or aboard the watercraft grasps the outer end of the invention with one hand on the main brace plate 4 and presses the release button 5 which rotates on it's hinge pin 11 forcing the push arm 8 down which opens the latch 9, shown in FIG. 3. The hinge pin 11 connects the release button 5 to the hinge pin plate 16 which is welded to the main brace 4 holding all in position, shown in FIG. 6. The push arm 8 serves as the moving connection between the release button 5 and the latch 9, the connecting points being the push arm pin 12 and the latch pin 13, shown in FIG. 3. As shown in FIG. 3 the push arm 8 forces the latch 9 to pivot open on the main tang pivot pin 14 allowing the device to be lifted free of the craft.

Once free of the craft and the craft has cleared, the device is released, the latch spring 17 of FIG. 4 closes the latch and gravity pivots the device down to rest vertically against the side of the dockage until needed.

The rigid, lockable and self closing mooring device, includes: a) the primary arm 2 and the brace arm 3; b) wherein each of the primary arm 2 and brace arm 3 includes a bent base; c) wherein the bent bases of the primary and brace arms 2, 3 are retained in barrel plate hinges 1; d) wherein each of the barrel plate hinges 1 includes an anchored position; e) wherein each of the anchored positions of the barrel plate hinges 1 creates a horizontal pivot axis; f) wherein the primary arm 2 and brace arm 3 meet at a juncture distant from the barrel plate hinges 1 and form a triangular shape; g) the small brace plate 6, wherein the small brace plate 6 is disposed over the juncture; h) wherein the primary arm 2 continues from the juncture in a radius to a primary arm end; i) wherein the primary arm end is milled to interlock with the latch 9; j) the large brace plate 4, wherein the large brace plate 4 joins the primary and brace arms 2, 3; k) the hinge pin plate 16, wherein the hinge pin plate 16 is connected to the large brace plate 4 thereby creating an anchor point; l) a release button assembly on the anchor point, wherein the release button assembly includes the release button 5 connected to the push arm 8 which is connected to the latch 9, wherein the release button 5 under externally applied pressure forces the push arm 8 to open the latch 9; m) the main brace tang 10, wherein the main brace tang 10 is affixed to the primary arm 2, wherein the latch 9 pivots on the pin 14 projecting thru the main brace tang 10; o) the spring 17 provides continual pressure on the latch 9 to force the latch 9 to integrate with the primary arm 2; p) wherein the continual pressure by the spring 17 also maintains the release button 5 in a ready position; and q) the lock aperture 7 drilled thru the main brace tang 10, wherein the lock aperture 7 is utilized to prohibit operation of the release assembly.

The mooring device further includes a flat plate portion for each of the barrel plate hinges 1. Each of the flat plate portions include pre drilled mounting holes. Each of the barrel plate hinges 1 fit onto the bent bases of the primary and brace arms 2, 3 and retain the primary and base arms 2, 3 in permanent locations while allowing the retained arms 2, 3 to pivot.

The primary arm 2 includes a length of round stock. The bent base of the primary arm 2 includes a short horizontal anchoring base section. The primary arm 2 further includes a long straight section. The bent base and long straight section are disposed at 90 degrees relative to each other. The long straight section forms one side of a triangular framework of the mooring device. The long straight section continues into a downwardly radius to the primary arm end. The primary arm end is machined to accept the latch 9 in a flush interlocking integration.

The brace arm 3 includes a length of round stock having a short bent section at each end. One of the short bent sections is the bent base of the brace arm 3. The bent sections are on the same plane. The bent sections have bend angles combining to equal 90 degrees. One end of the brace arm 3 is attached to the primary arm 2 and thereby forms an apex of a right triangle. The other end of the brace arm 3 has the bent base. The bent base of the brace arm 3 is on the same linear line as the bent base of the primary arm 2.

The large brace plate 4 includes a fixed position and reinforces the primary arm 2 and the brace arm 3. The fixed position provides a foundation for the release button assembly.

The small brace plate 6 connects the primary arm 2 and brace arm 3 at the juncture.

The latch 9 is machined of a comparable material to, and forms a flush integration with, the primary arm 2, from where the latch 9 continues to the main brace tang 10, at which point the latch 9 is slotted to straddle the main brace tang 10 and to include a slotted end. The slotted end continues to a termination beyond the main brace tang 10. The slotted end is drilled perpendicularly thru to accept the latch pin 13 of the push arm 8 and also is drilled perpendicularly thru to accept the main brace tang pivot pin 14 of the main brace tang 10. The latch 9 is drilled laterally to house the spring 17.

The main brace tang 10 is manufactured of flat stock, is anchored to the primary arm 2, and accepts and guides a swinging motion of the latch 9. The main brace tang 10 also includes drilled apertures, with one drilled aperture being for the main brace tang pivot pin 14 and with one drilled aperture being the lock aperture 7.

The lock aperture 7 in the main brace tang 10 is sized to accept a separate locking device. The lock aperture 7 is located to prevent latch movement when the lock aperture 7 is utilized.

The mooring device further includes the main tang pivot pin 14. The main tang pivot pin 14 is a steel pin. The main tang pivot pin 14 is a stationary pivot pin. The main tang pivot pin 14 passes thru the latch 9 and a slot formed in the latch 9 in a direction perpendicular to a length of the latch 9. The main tang pivot pin 14 passes freely thru an access 15 provided in the main brace tang access, thus creating a stationary pivot point for the latch 9.

The mooring device further includes the latch pivot pin 13. The latch pivot pin 13 passes perpendicularly thru a slotted end of the latch 9, continuing freely thru the push arm 8, thereby providing a pivoting connection point for the latch 9 and the push arm 8.

The push arm 8 includes a formed connecting plate having a drilled access hole at either end. One of the drilled access holes freely accepts the latch pivot pin 13 of the latch 9. The other of the drilled access holes freely accepts the push arm pin 12 of the push arm 8, thereby forming a connection between the release button 5 and the latch 9.

The mooring device further includes the push arm pivot pin 12. The push arm pivot pin 12 is mounted to a release button body of the release button 5 and protrudes and passes freely thru the push arm 8, thereby connecting the release button 5 and the push arm 8.

The release button 5 is formed to fit a position between the primary arm 2 and brace arm 3 at an apex of the primary arm 2 and brace arm 3. The hinge pin plate 16 is connected to the large brace plate 4 and the release button hinge pin 11 is connected to the hinge pin plate 16. The release button hinge pin 11 and the push arm pin 12 of the push arm 8 allows the release button 5 to open the latch 9.

The release button hinge pin 11 passes thru one side of the hinge pin plate 16, continues freely thru release button mounting holes formed in the release button 5, then passes thru the other side of the hinge pin plate 16 where the release button hinge pin 11 terminates. The release button hinge pin 11 allows the release button 5 to pivot under pressure.

A release button hinge plate 16 is connected between the release button 5 and the large brace plate 4. The release button hinge plate 16 consists of a formed steel plate attached to the large brace plate 4. The release button hinge plate 16 includes hinge plate sides formed and drilled to accept the release button hinge pin 11.

The spring 17 is positioned within the latch 9 and is compressed against the main brace tang 10 so as to impart constant pressure on the latch 9 to maintain an integrated position with the primary arm 2. The constant pressure on the latch 9 also maintains the release button 5 in a ready position.

Though this invention has been described in connection with a preferred embodiment it shall be understood that various renditions, modifications, additions and or alterations may be made to the invention by one skilled in the art without departing from the essence, scope, and spirit of the invention as defined in the appended claims.

The embodiments of the invention of the invention in which an exclusive property or privilege is claimed are defined as:

1. A rigid, lockable and self closing mooring device, comprising:

a) a primary arm and a brace arm;

b) wherein each of the primary arm and brace arm includes a bent base;

c) wherein the bent bases of the primary and brace arms are retained in barrel plate hinges;

d) wherein each of the barrel plate hinges includes an anchored position;

e) wherein each of the anchored positions of the barrel plate hinges creates a horizontal pivot axis;

f) wherein the primary arm and brace arm meet at a juncture distant from the barrel plate hinges and form a triangular shape;

g) a small brace plate, wherein the small brace plate is disposed over the juncture;

h) wherein the primary arm continues from the juncture in a radius to a primary arm end;

i) wherein the primary arm end is milled to interlock with a latch;

j) a large brace plate, wherein the large brace plate joins the primary and brace arms;

k) a hinge pin plate, wherein the hinge pin plate is connected to the large brace plate thereby creating an anchor point;

l) a release button assembly on the anchor point, wherein the release button assembly includes a release button connected to a push arm which is connected to said latch, wherein the release button under externally applied pressure forces said push arm to open the latch;

m) a main brace tang, wherein the main brace tang is affixed to the primary arm, wherein the latch pivots on a pin projecting thru the main brace tang;

o) a spring providing continual pressure on the latch to force the latch to integrate with the primary arm;

p) wherein the continual pressure by the spring also maintains the release button in a ready position; and q) a lock aperture drilled thru the main brace tang, wherein the lock aperture is utilized to prohibit operation of the release assembly.

2. The mooring device of claim 1, and further comprising a flat plate portion for each of the barrel plate hinges, wherein each of the flat plate portions includes pre drilled mounting holes, wherein each of the barrel plate hinges fit onto the bent bases of the primary and brace arms and retain the primary and base arms in permanent locations while allowing the retained arms to pivot.

3. The mooring device of claim 1, wherein the primary arm comprises a length of round stock, wherein the bent base of the primary arm comprises a short horizontal anchoring base section, wherein the primary arm further comprises a long straight section, with the bent base and long straight section being disposed at 90 degrees relative to each other, wherein said long straight section forms one side of a triangular framework of the mooring device, wherein the long straight section continues into a downwardly radius to the primary arm end, and wherein the primary arm end is machined to accept the latch in a flush interlocking integration.

4. The mooring device of claim 1, wherein the brace arm comprises a length of round stock having a short bent section at each end, with one of the short bent sections being said bent base of the brace arm, with the bent sections being on the same plane, with said bent sections having bend angles combining to equal 90 degrees, with one end of said brace arm attached to the primary arm and thereby forming an apex of a right triangle, with the other end of said brace arm having said bent base, with said bent base of the brace arm being on the same linear line as the bent base of the primary arm.

5. The mooring device of claim 1, wherein the large brace plate includes a fixed position and reinforces the primary arm and the brace arm, and wherein said fixed position provides a foundation for the release button assembly.

6. The mooring device of claim 1, wherein the small brace plate connects the primary arm and brace arm at the juncture.

7. The mooring device of claim 1, wherein the latch is machined of a comparable material to, and forms a flush integration with, the primary arm, from where the latch continues to the main brace tang, at which point the latch is slotted to straddle the main brace tang and to include a slotted end, the slotted end continuing to a termination beyond the main brace tang, the slotted end being drilled perpendicularly thru to accept a latch pin of the push arm and also being drilled perpendicularly thru to accept a main brace tang pivot pin of the main brace tang, and the latch being drilled laterally to house the spring.

8. The mooring device of claim 1, wherein said main brace tang is manufactured of flat stock, is anchored to the primary arm, and accepts and guides a swinging motion of the latch, the main brace tang also having drilled apertures, with one drilled aperture being for a main brace tang pivot pin and with one drilled aperture being said lock aperture.

9. The mooring device of claim 1, wherein the lock aperture in the main brace tang is sized to accept a separate locking device, said lock aperture being located to prevent latch movement when said lock aperture is utilized.

10. The mooring device of claim 1, and further comprising a main tang pivot pin, with the main tang pivot pin being a steel pin, with the main tang pivot pin being a stationary pivot pin, wherein the main tang pivot pin passes thru said latch and a slot formed in the latch in a direction perpendicular to a length of the latch, wherein the main tang pivot pin passes freely thru an access provided in the main brace tang access, thus creating a stationary pivot point for the latch.

11. The mooring device of claim 1, and further comprising a latch pivot pin, wherein said latch pivot pin passes perpendicularly thru a slotted end of the latch, continuing freely thru the push arm, thereby providing a pivoting connection point for the latch and the push arm.

12. The mooring device of claim 1, wherein the push arm comprises a formed connecting plate having a drilled access hole at either end, wherein one of the drilled access holes freely accepts a latch pivot pin of the latch, wherein the other of the drilled access holes freely accepts a push arm pin of said push arm, thereby forming a connection between the release button and the latch.

13. The mooring device of claim 1, and further comprising a push arm pivot pin, wherein the push arm pivot pin is mounted to a release button body of the release button and protrudes and passes freely thru the push arm, thereby connecting said release button and the push arm.

14. The mooring device of claim 1, wherein the release button is formed to fit a position between the primary arm and brace arm at an apex of the primary arm and brace arm, and further comprising a hinge pin plate connected to the large brace plate and a release button hinge pin connected to the hinge pin plate, and wherein the release button hinge pin and a push arm pin of the push arm allows the release button to open the latch.

15. The mooring device of claim 14, wherein the release button hinge pin passes thru one side of the hinge pin plate, continues freely thru release button mounting holes formed in said release button, then passes thru the other side of the hinge pin plate where the release button hinge pin terminates, said release button hinge pin allowing the release button to pivot under pressure.

16. The mooring device of claim 1, and further comprising a release button hinge plate connected between the release button and the large brace plate, wherein the release button hinge plate consists of a formed steel plate attached to the large brace plate, and wherein the release button hinge plate includes hinge plate sides formed and drilled to accept a release button hinge pin.

17. The mooring device of claim 1, wherein the spring is positioned within the latch and is compressed against the main brace tang so as to impart constant pressure on the latch to maintain an integrated position with the primary arm, with said constant pressure on the latch also maintaining the release button in a ready position.

18. A rigid, lockable and self closing mooring device, comprising:

a) a primary arm and a brace arm;

b) wherein each of the primary arm and brace arm includes a bent base;

c) wherein the bent bases of the primary and brace arms are retained in barrel plate hinges;

d) wherein each of the barrel plate hinges includes an anchored position;

e) wherein each of the anchored positions of the barrel plate hinges creates a horizontal pivot point;

f) wherein the primary arm and brace arm meet at a juncture distant from the barrel plate hinges and form a triangular shape;

g) wherein the primary arm continues from the juncture in a radius to a primary arm end;

h) wherein the primary arm end is milled to interlock with a latch;

i) a large brace plate, wherein the large brace plate joins the primary and brace arms;

j) a hinge pin plate, wherein the hinge pin plate is connected to the large brace plate thereby creating an anchor point;

k) a release button assembly on the anchor point, wherein the release button assembly includes a release button connected to a push arm which is connected to said latch, wherein the release button under externally applied pressure forces said push arm to open the latch;

l) a main brace tang, wherein the main brace tang is affixed to the primary arm, wherein the latch pivots on a pin projecting thru the main brace tang;

m) a spring providing continual pressure on the latch to force the latch to integrate with the primary arm;

n) wherein the continual pressure by the spring also maintains the release button in a ready position; and o) a lock aperture drilled thru the main brace tang, wherein the lock aperture is utilized to prohibit operation of the release assembly.

19. A rigid, lockable and self closing mooring device, comprising:

a primary arm and a brace arm, each of the primary and brace arms having a bent base, said bent bases of said primary and brace arms retained in barrel plate hinges, an anchored position of the barrel plate hinges creating a horizontal pivot point, the primary and brace arms meeting at a juncture distant from the barrel plate hinges and forming a triangular shape, the primary arm continuing from said juncture into a radius and further to an end, said end milled to interlock with a latch, a brace plate joining the primary and brace arms, a hinge pin plate connected to said brace plate creating an anchor point for a release button assembly wherein a release button which under externally applied pressure forces a push arm to open a latch arm, said latch arm pivoting on a pin projecting thru a tang, said tang affixed to the primary arm, a spring providing continual pressure on the latch forcing said latch to integrate with the primary arm, said continual pressure also maintaining the release button in a ready position, and a lock aperture drilled thru said tang, said aperture being utilized to prohibit operation of the release assembly.

* * * * *